US005122085A

United States Patent [19]

Heath

[11] Patent Number: 5,122,085

[45] Date of Patent: Jun. 16, 1992

[54] WATER SPORTS BOARD

[76] Inventor: Clayton L. Heath, Rte. 1, Box 3, Riegelwood, N.C. 28456

[21] Appl. No.: 594,312

[22] Filed: Oct. 9, 1990

[51] Int. Cl.[5] ..... B63B 35/72

[52] U.S. Cl. ..... 441/65; 441/74

[58] Field of Search ..... 441/65, 68, 73, 74, 441/79; 114/363; D21/228

[56] References Cited

U.S. PATENT DOCUMENTS

| | | | |
|---|---|---|---|
| 1,853,159 | 4/1932 | Welsh | 441/74 |
| 2,841,805 | 7/1958 | Roudebush | 114/253 |
| 3,147,498 | 9/1964 | Convis | 441/65 |
| 3,380,425 | 4/1968 | Wilson | 441/74 |
| 4,840,590 | 6/1989 | Kelley | 441/74 |
| 4,857,025 | 8/1989 | Brown et al. | 441/65 |

FOREIGN PATENT DOCUMENTS

| | | | |
|---|---|---|---|
| 2519224 | 11/1976 | Fed. Rep. of Germany | 441/74 |

*Primary Examiner*—Edwin L. Swinehart
*Attorney, Agent, or Firm*—Olive & Olive

[57] ABSTRACT

A towable water sports board which is attached to a motor boat directly by a tow rope and which comprises an elongated planar board, a tow line attachment means positioned near one end at the bottom of the board; and a footrest positioned above the other end of the board. Preferably the footrest extends across the rear end of the board, being generally perpendicular to the axis of elongation of the board. The tow line attachment means is preferably a passage opening on to the lower surface of the board through two openings. The board also has a forward elevated portion. There also may be an elevated edge piece on each side of the board on the upper surface extending from the footrest to the forward elevated portion.

12 Claims, 5 Drawing Sheets

WATER SPORTS BOARD

BACKGROUND OF THE INVENTION

1. Field of the Invention

This invention relates to a water sports board which is towed by a motor boat or similar water vehicle while a rider stands on the board.

2. Description of the Related Art

While the sport of water skiing is not new, the concept of the towable water board of the invention is new. Unlike water skis with which the rider must hold the tow rope, the tow rope from the towing boat attaches directly to the water sports board. Water skiing is a physically demanding sport and for that reason unavailable as a water sport for many people. Because water skiing requires the skier to hold onto the motor boat's tow rope directly while the skier maintains control over the skies, water skiing can be difficult and physically taxing. Attempts to relieve the physical demands of water skiing include surfboards having a chair area or seat so that the skier may sit while holding to the rope. See, for example. U.S. Pat. No 4,857,025 of Brown.

The sport of water surfing also is not new, however, the ability to simulate surfing in other water locations besides the ocean waves is new. Surfing is also a physically demanding sport and generally unavailable to those people not living near an ocean.

Previous towable boards allow people to sit and be towed upon the water, the towable water board of the invention allows the rider to simulate more closely the sports of water skiing and surfing because the rider stands on the towable water board and controls the movements by shifting his or her weight on the board. Other boards or ski devices require the rider to hold onto the towing rope while sitting or standing upon them.

It is therefore an object of this invention to provide a water board which is towable by a boat. It is a further object of this invention to provide a water board constructed so that a person may stand on it to be towed on the water without holding on to a rope. It is a further object of the invention to provide a water board that remains attached to the towing boat when the rider has fallen off the board.

The water sports board may be ridden through both calm and rough waters and is usable at variable motor boat speeds. This flexibility makes use of the water sports board available for riders of many different skill levels.

Other objects and advantages will be mor fully apparent from the following disclosure and appended claims.

SUMMARY OF THE INVENTION

The present invention provides a towable water sports board which is attached to a motor boat directly by a tow rope. In particular, the towable water board of the invention comprises an elongated planar board having an upper surface and a lower surface; a tow line attachment means positioned near the forward end of the lower surface; and a footrest positioned at the rearward end of the upper surface. Preferably the footrest extends across all or most of the rear end of the board in a manner generally perpendicular to the axis of elongation of the board. The footrest is preferably slanted backward away from the remainder of the board. In the preferred embodiment, the footrest forms an angle of about 135 degrees from the plane of the upper surface.

The footrest may comprise a curved surface which supports a rider's heel resting on the upper surface.

The tow line attachment means is preferably provided by a passage in the board which opens to the lower surface of the board, preferably through two openings.

The towable water board optionally further comprises a forward elevated portion. The elevated portion is preferably about the height of the footrest but may be higher or lower. In a further embodiment, the towable water board comprises an elevated edge piece on each side of the board on the upper surface, each edge piece extending from the footrest to the forward elevated portion.

Four main embodiments of the invention are discussed below, it being understood that the components of each may be combined or altered according to other embodiments or as known in the art. In the first embodiment (FIGS. 1–10), the water board comprises both a rearward footrest and a forward elevated portion, with the elevated portion having a central indentation toward the rear of the elevated portion. In the second embodiment (FIG. 11), the rearward footrest is planar and integral with the board, and extends upward and backward at an oblique angle from the board. The rear edge of the forward elevated portion is straight and perpendicular to the longitudinal axis of the board. In the third embodiment (FIGS. 12–13), elevated edge pieces extend between a rear footrest and a forward elevated portion. In the fourth embodiment (FIG. 14), the upper surface of the board tapers downward from the front elevated portion to the base of the footrest.

After the water sports board's tow line is attached to the boat, and after the boat pulls the slack out of the tow line, the rider grasps both sides of the water board and places one foot onto the board while dangling the other in the water (or while the other foot rests on the floor of the lake or ocean). As the boat accelerates, the rider gradually brings the second foot onto the board and stands. The rider can change directions and slalom behind the towing boat by shifting the weight on his feet from side to side. This method of riding allows the rider to ride in the wake of the towing boat or to ride on the crest of the wake much like surfing. The speed of the towing boat can vary according to the skill level of the rider. The water sports board is usable in calm or rough waters. Its design allows the water sports board to stay afloat to follow the towing boat should the rider dismount from the water board at any time during the towing.

Other aspects and features of the invention will be more fully apparent from the following disclosure and appended claims.

DETAILED DESCRIPTION OF THE INVENTION AND PREFERRED EMBODIMENTS THEREOF

Figure 1:
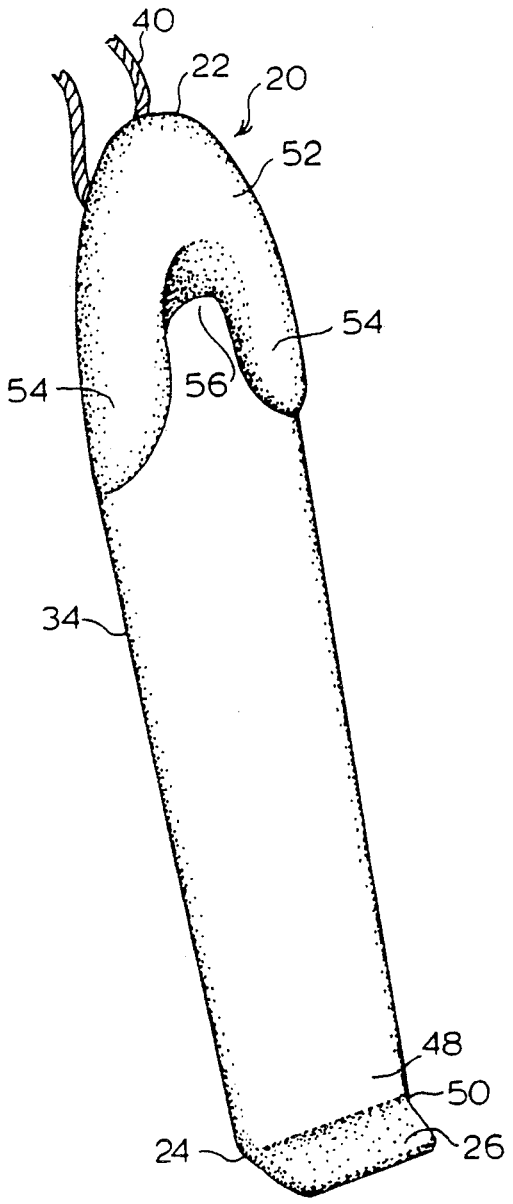
FIG. 1 is a perspective view of a first embodiment of the water sports board invention.

The invention comprises a towable water sports board upon which a rider stands while a towing boat tows the water sports board behind it. The water sports board may be ridden and maneuvered by the rider through calm and rough water, at varying speeds from very slow to very fast. The water sports board is a generally flat board. The bottom of the water board preferably has no obtrusions, and the top of the water board has a rear footrest structure. The board also has a front buoyant elevated structure.

Board 20 may be constructed of any material which is light and capable of supporting a rider in the water. A possible composition of board 20 consists of a wooden core piece coated with fiberglass and/or polyurethane substances or a board made completely of such substances, but any suitable material(s) such as those used for surfboards may be used.

The water sports board of the invention comprises an elongated board 20 having a forward first end 22 and a rearward second end 24 (FIGS. 1–4, and 11–14). In each embodiment, a footrest structure 26 is located at or near the rearward end 24 of the board, extending across the rear end of the board generally perpendicular to the axis of elongation 28 of the board, and extending upward and backward from the remainder of the board.

Board 20, generally rectangular in shape, is rounded and may taper gently to a rounded point at its forward end 22 and narrows slightly in width from the wider first end to its rearward end 24. The length and width of board 20 may vary to a great extent with there being no one ideal proportion of length to width. The only limitation is that the board 20 must have measurements that makes it feasible to maintain the stability of board 20 for the rider in the water. The preferred length of board 20 as shown in FIGS. 1–10, and 12–14, is about 4 feet 8 inches. At its widest point 30 toward the front of the board about 14 inches from the nose of the board, board 20 preferably measures about 14 inches across, and at its narrowest point at the rear end 24 it measures about 11 inches across. In the second longer embodiment shown in FIG. 11, board 20 comprises a longer board measuring about 5 feet 8 inches long, which is also about 14 inches at its widest point and about 10 inches at the narrowest portion.

Figure 2:
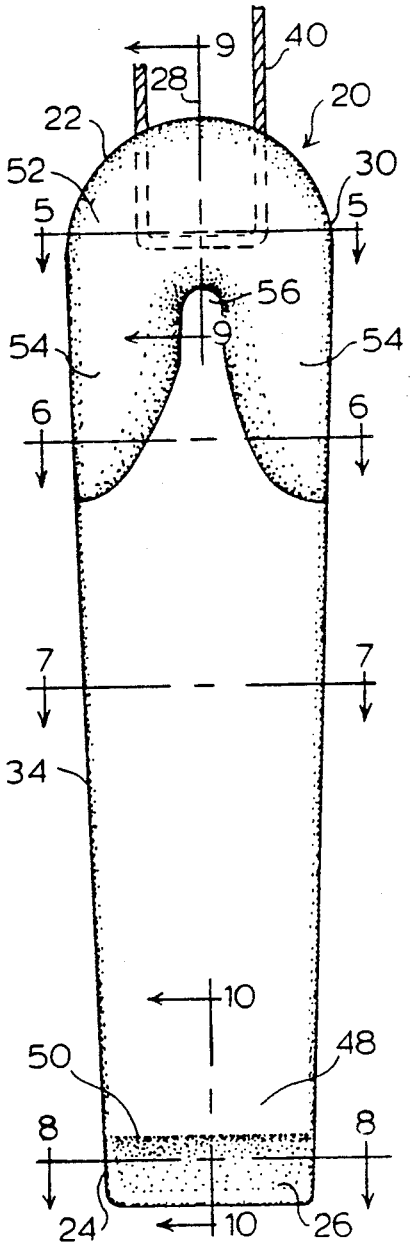
FIG. 2 is a top plan view of the water sports board shown in FIG. 1.
Figure 5:
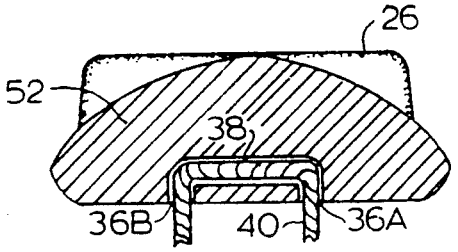
FIG. 5 is a latitudinal cross-sectional view taken along line 5—5 of FIG. 2.
Figure 3:
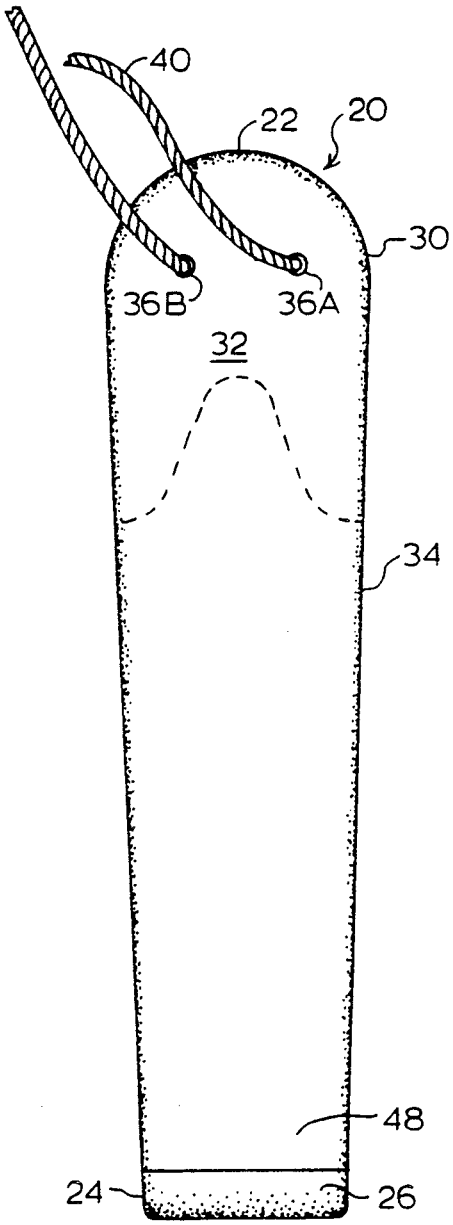
FIG. 3 is a bottom plan view of the water sports board shown in FIG. 2.
Figure 16:
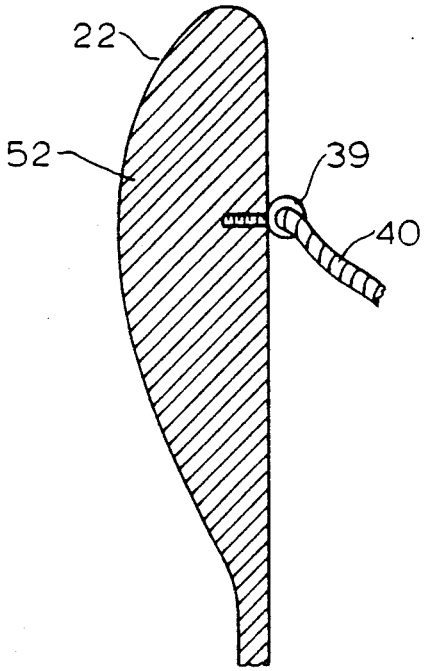
FIG. 16 is a longitudinal cross-sectional view of an alternative tow line attachment means

The bottom side 32 of board 20, shown in plan view in FIG. 3, and the central area of the top of the board (FIG. 1) are generally flat. For experienced riders, one or more fins may be placed on the bottom of the board 20, for example, as is known for surfboards (not shown). The board 20 preferably has rounded or tapered edges 34 around the circumference as shown in cross-section in FIG. 7. There are two openings 36A and 36B toward the forward end 22 of board 20 which are the openings of passage 38 which extends through board 20 perpendicular to the long axis 28 (FIGS. 2–3). Passage 38 preferably is formed by being molded during manufacture of the board 20 or it may be cut into the board 20. Openings 36A and 36B are equidistant from the center of the board 20, and are also equidistant from the foremost edge of board 20. Passage 38 houses tow line 40 by which a towing boat attaches to board 20. FIG. 5 shows a latitudinal cross-sectional view, and FIG. 9 a longitudinal crosssectional view, of passage 38. Passage 38 could be replaced with a single hole for attachment of a single rope (FIG. 16). For example, a swivel eye 39 could be attached to the bottom of the forward end of the board.

In each embodiment, a footrest 26 is positioned at the rearward end 24 of the board 20. The footrest 26 may be provided by providing a bend in board 20 so that the rear of the board extends upward from the plane of the rest of the board, preferably so that it extends backward at an obtuse angle 44 from the board. The angle 44 is preferably approximately 135 degrees but may vary from between about 90 to less than 180 degrees, the only limitation being the need to create a workable and comfortable footrest 26 for the rider. In each embodiment, the footrest 26 is generally a flat surface and is formed integrally, smoothly and without discontinuity with the board 20.

Figure 7:
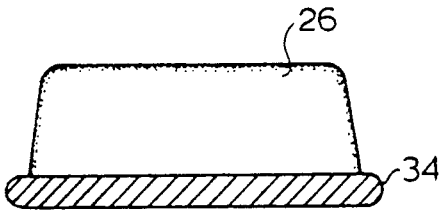
FIG. 7 is a latitudinal cross-sectional view taken along line 7—7 of FIG. 2.
Figure 8:
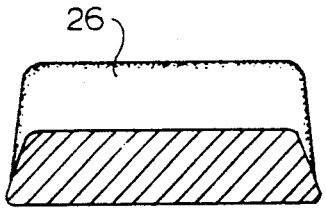
FIG. 8 is a latitudinal cross-sectional view taken along line 8—8 of FIG. 2.

When viewed from the forward end or center of the board, the footrest 26 is generally rectangular with the upper width being slightly less than the lower width of the footrest 26 (FIGS. 7–8).

In the second embodiment (FIG. 11), the footrest 26 is a simple angled extension of the board 20. In the remaining embodiments, an additional footrest molded area 48 is formed on the forward side of the footrest 26 extending from the top of the footrest 26 downward to an inward curvature 50 and along the rearward portion of the board 20 (FIGS. 1–2, 4 and 10).

The height of the footrest 26 is preferably about 3 inches, and preferably in the range of about 2-½ to 4 inches, the primary limitations being that the footrest 26 should be high enough to provide an adequate brace for a foot, but not so high as to create difficulties in handling or maneuverability of the water board in the water or on land. Preferably the footrest 26 is not higher than the elevated portion 52 (discussed below).

Figure 6:
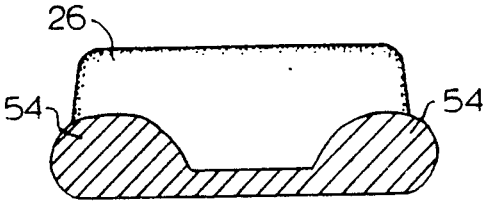
FIG. 6 is a latitudinal cross-sectional view taken along line 6—6 of FIG. 2.
Figure 4:
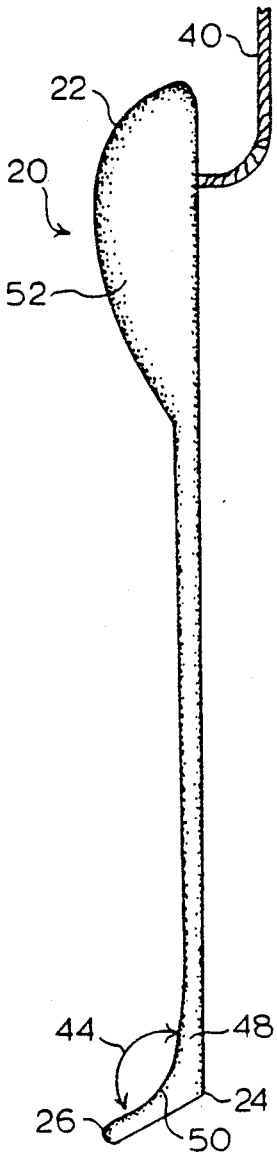
FIG. 4 is an elevational view of the water sports board shown in FIG. 2.
Figure 9:
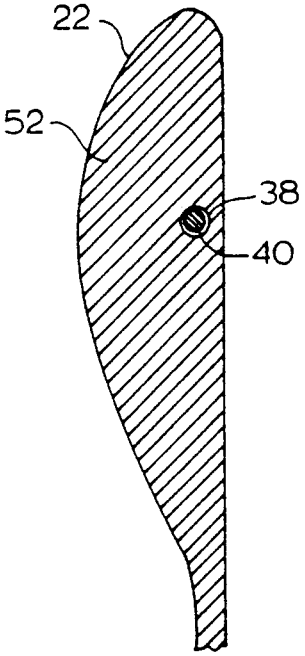
FIG. 9 is a longitudinal cross-sectional view taken along line 9—9 of FIG. 2.
Figure 10:
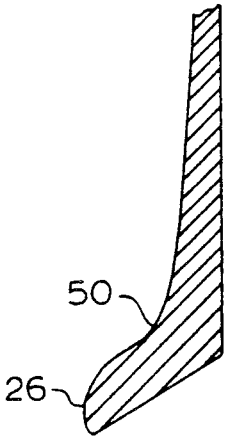
FIG. 10 is a longitudinal cross-sectional view taken along line 10—10 of FIG. 2.

Elevated portion 52, shown for the first embodiment in FIGS. 1,2 and 4 may be placed at the forward end 22 of board 20 in a dome-like structure which may be flattened. FIGS. 5 and 6 show cross-sectional views of the first embodiment elevated portion 52. From the front end of board 20, elevated portion 52 slopes upward into the dome-like structure. In the first embodiment, elevated portion 52 extends rearward along the sides of board 20 for approximately 8 to 14 inches forming side pieces 54 having a recessed area 56 between them as shown generally in FIGS. 1 and 2, and in cross-sectional view in FIG. 6. Elevated portion 52 acts to keep board 20 buoyant, with the forward portion as well as the rear portion of the board kept floating, should board 20 get separated from the rider while the towing boat is still in motion. When pulled, board 20 follows behind the boat atop the water rather than having its forward portion being pulled downward into the water.

Figure 11:
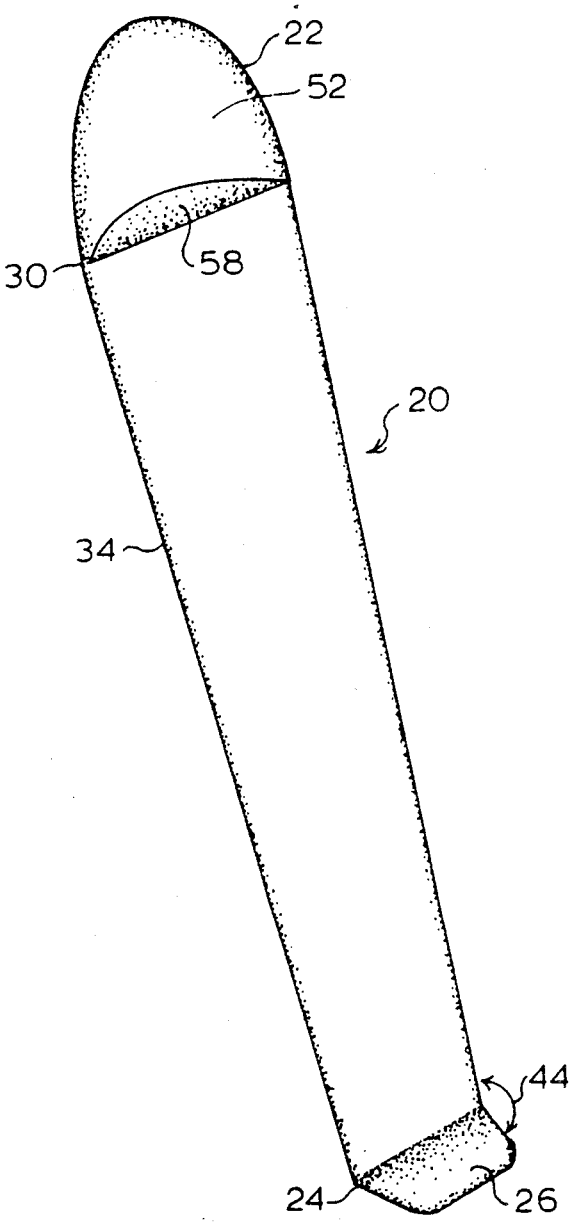
FIG. 11 is a perspective view of a second embodiment of the water sports board shown in FIG. 2.

A second embodiment of board 20 has no side pieces 54 (FIG. 11). In this embodiment, the elevated portion 52 of board 20 simply drops at about a 90 degree angle to the top side of board 20 along the straight rear edge 58 of elevated portion 52.

Figure 12:
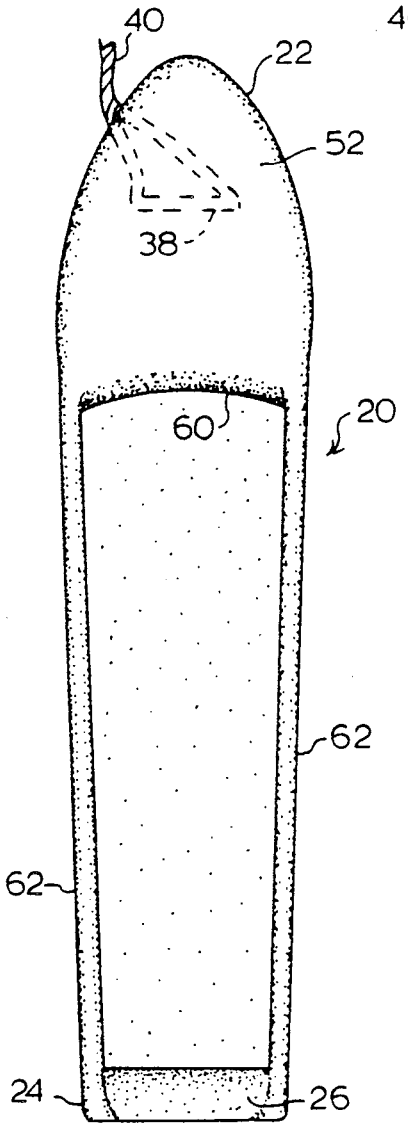
FIG. 12 is a top plan view of a third embodiment of the invention in which the board has sides.
Figure 13:
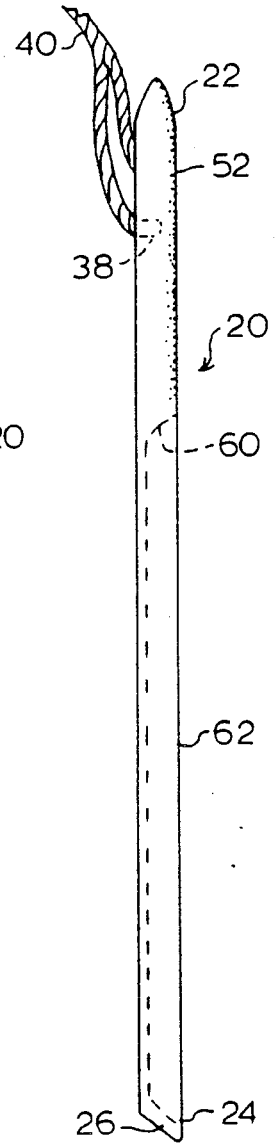
FIG. 13 is an elevational view of the third embodiment.

In the third embodiment, the rear of the elevated portion 52 forms a gentle curve 60 and elevated edge pieces 62 extend from the elevated portion 52 at the forward end of the board to the footrest 26 at the back of the board, to provide additional means of keeping the rider's feet on the board and in stabilizing an empty board in the water (FIGS. 12–13). The edge pieces 62 may be the same height as or lower than the elevated end portion 52 and footrest 26, and may be a part of the board 20 as molded or may be added to a board 20. If the ends of the board are of different heights, the upper edge edge pieces 62 may be slanted between the ends (not shown).

Figure 14:
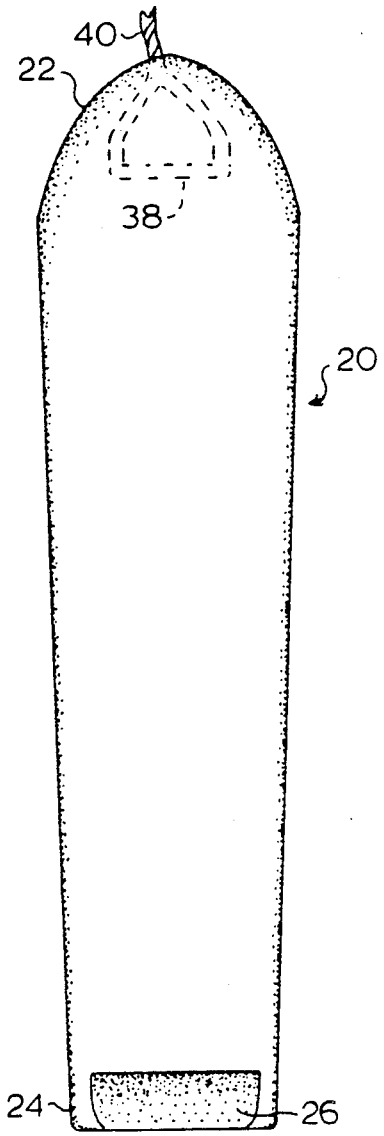
FIG. 14 is a top plan view of a fourth embodiment of the invention in which the upper surface of the board angles downward from the front elevated portion to the footrest.
Figure 15:
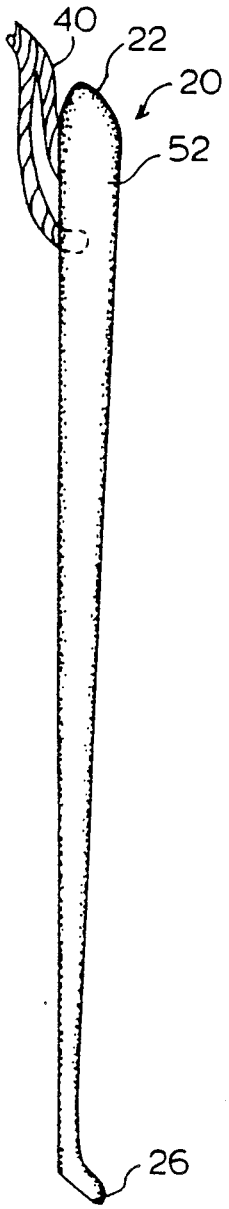
FIG. 15 is an elevational view of the fourth embodiment.

In the fourth embodiment, rather than a discrete forward elevated portion 52 being present, the board is gently tapered from the elevated forward portion 52 down to the base of the footrest (FIGS. 14–15).

Although the versions of the various components, such as the elevated portion 52, footrest 26 and edge pieces 62 and the length of board 20 differ between embodiments and are combined in particular ways in the four particular embodiments discussed herein, it is contemplated that the invention includes additional embodiments in which each version of the various components, e.g., the presence and style of an elevated portion, may be combined in alternate ways with each of the different versions of the other components.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A towable water board comprising:

(a) an elongated board having an upper surface on which a person may ride and a lower surface, said board and each of said surfaces having a first end and a second end; said water board having a means of tow line attachment located toward the first end of said lower surface;

(b) an elevated portion at the first end of the board; and (c) a footrest positioned at the second end of said upper surface and extending upward at an oblique angle from the upper surface to an upper end; and extending at an angle away from the first end of the board, wherein a foot of the person may be placed on the upper surface and be braced against the footrest. wherein said lower surface forms a lower plane extending between the first and second ends of said lower surface; wherein said upper surface forms a central planar area between said elevated portion and said footrest; and wherein adjacent said footrest, said central planar area is closer to said lower plane then is the upper end of said footrest.

2. A towable water board according to claim 1, further comprising a tow line attached to said board at said tow line attachment means.

3. A towable water board according to claim 1, wherein said elevated portion is at least the height of said footrest.

4. A towable water board according to claim 1, wherein said footrest comprises a raised piece placed perpendicular to the axis of elongation of the board.

5. A towable water board according to claim 4, wherein said footrest forms an angle of about 135 degrees from the planar area of said upper surface.

6. A towable water board according to claim 4, wherein said footrest comprises a curved and molded piece which supports the person's foot resting on said upper surface.

7. A towable water board according to claim 1, wherein the board has an interior passage comprising the means of tow line attachment.

8. A towable water board according to claim 7, wherein said passage opens on to the lower surface of the board through one or two openings.

9. A towable water board according to claim 1, wherein the upper surface of the board tapers gradually downward from the elevated portion to the position of the footrest on the upper surface.

10. A towable water board according to claim 1 wherein the width of said board is about 14 inches at its widest point and about 10 inches to 11 inches at its narrowest point and wherein the length of said board ranges from about 4 feet 8 inches to about 5 feet 8 inches.

11. A towable water board according to claim 1, further comprising an elevated edge piece on each side of the board on the upper surface, each edge piece extending from the footrest to the forward elevated portion.

12. A towable water board according to claim 1, wherein the means of tow line attachment comprises a single hole for attachment of a tow line.

* * * * *